US008155364B2

(12) United States Patent
An et al.

(10) Patent No.: US 8,155,364 B2
(45) Date of Patent: Apr. 10, 2012

(54) ELECTRONIC DEVICE WITH MICROPHONE ARRAY CAPABLE OF SUPPRESSING NOISE

(75) Inventors: Yan An, Shanghai (CN); Xiao-Hu Yu, Shanghai (CN)

(73) Assignee: Fortemedia, Inc., Sunnyvale, CA (US)

( * ) Notice: Subject to any disclaimer, the term of this patent is extended or adjusted under 35 U.S.C. 154(b) by 1190 days.

(21) Appl. No.: 11/935,482

(22) Filed: Nov. 6, 2007

(65) Prior Publication Data

US 2009/0116658 A1 May 7, 2009

(51) Int. Cl.
*H04R 25/00* (2006.01)

(52) U.S. Cl. ..... 381/357; 381/355; 381/365

(58) Field of Classification Search ..... 381/92, 381/313, 322, 324, 328, 355, 356, 357, 358, 381/361, 365; 379/420.03, 433.03, 388.02, 379/420.01, 420.02; 455/569.1
See application file for complete search history.

(56) References Cited

U.S. PATENT DOCUMENTS 5,121,426 A * 6/1992 Baumhauer et al. ..... 379/420.03
6,151,399 A * 11/2000 Killion et al. ..... 381/313
7,013,014 B2 * 3/2006 Ach-Kowalewski et al. . 381/313
7,403,611 B1 * 7/2008 He et al. ..... 379/420.01
7,664,284 B2 * 2/2010 Zhang et al. ..... 381/355

FOREIGN PATENT DOCUMENTS

CN 1643571 7/2005
EP 0 637 187 2/1995

OTHER PUBLICATIONS

Chinese language office action dated Sep. 15, 2011.
English language translation of abstract of CN 1643571 (published Jul. 20, 2005).

* cited by examiner

*Primary Examiner* — Huyen D Le
(74) *Attorney, Agent, or Firm* — Thomas|Kayden

(57) ABSTRACT

An electronic device includes a first acoustic opening, a first microphone, a second acoustic opening, a second microphone, two flexible boots, and two chambers. The first microphone receives sound through the first acoustic opening. The second microphone receives the sound through the second acoustic opening. The first and second acoustic openings are spaced at least about 8 cm. The first microphone and the second microphone are identical and disposed in the flexible boots. The flexible boots are identical and disposed in the chambers. The chambers are identical.

5 Claims, 11 Drawing Sheets

ELECTRONIC DEVICE WITH MICROPHONE ARRAY CAPABLE OF SUPPRESSING NOISE

BACKGROUND OF THE INVENTION

1. Field of the Invention

The invention relates to an electronic device with a microphone array capable of forming a super-short-heart-shaped beam, receiving a designated signal within the beam, and effectively suppressing noise.

2. Description of the Related Art

A microphone array is capable of clearly receiving sound from a particular direction while avoiding surrounding noise, and is often applied in high-quality audio recorders or communications devices.

There are different types of microphone arrays. For example, a broadband microphone array includes two omni-directional microphones simultaneously receiving sound, forming a pie beam to receive a designated signal within the beam, and suppressing noise outside of the beam. For another example, a SAM (small array microphone) includes a uni-directional microphone and an omni-directional microphone simultaneously receiving sound and forming a cone beam to receive the designated signal within the beam. Alternatively, a SAM includes two omni-directional microphones simultaneously receiving sound and forming a pie beam or a cone beam to receive the designated signal within the beam.

Regardless of what beam (a pie beam or a cone beam) is formed to receive the designated sound signal, acoustic leakage occurs within the beam. This problem can be lessened by narrowing the beam angle. However, ambient noise within the beam would still not be effectively suppressed.

BRIEF SUMMARY OF THE INVENTION

The invention provides an electronic device with a microphone array capable of forming a super-short-heart-shaped beam, picking up a designated signal within the beam, and effectively suppressing noise.

An electronic device in accordance with an exemplary embodiment of the invention comprises a first acoustic opening, a first microphone, a second acoustic opening, a second microphone, two flexible boots, and two chambers. The first microphone receives sound through the first acoustic opening. The second microphone receives the sound through the second acoustic opening. The first and second acoustic openings are spaced at least about 8 cm. The first microphone and the second microphone are identical and disposed in the flexible boots. The flexible boots are identical and disposed in the chambers. The chambers are identical.

The electronic device can be modified in various ways. In another exemplary embodiment of the invention, the first acoustic opening and the second acoustic opening are identical.

In yet another exemplary embodiment of the invention, the electronic device further comprises a housing in which the first microphone and the second microphone are disposed, wherein the first and second acoustic openings are provided in the housing.

In another exemplary embodiment of the invention, the electronic device further comprises a circuit board and a plurality of electrical wires through which the first microphone and the second microphone are connected to the circuit board.

In yet another exemplary embodiment of the invention, the electronic device further comprises a loudspeaker, wherein the second microphone is closer to the loudspeaker than the first microphone.

In another exemplary embodiment of the invention, the electronic device further comprises a loudspeaker, wherein the second microphone is farther from the loudspeaker than the first microphone.

In yet another exemplary embodiment of the invention, both the first microphone and the second microphone are omni-directional microphones.

Meanwhile, the electronic device can be a cellular phone, an earphone, MP3 player, personal digital assistant (PDA), a sound recorder, or other similar devices.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
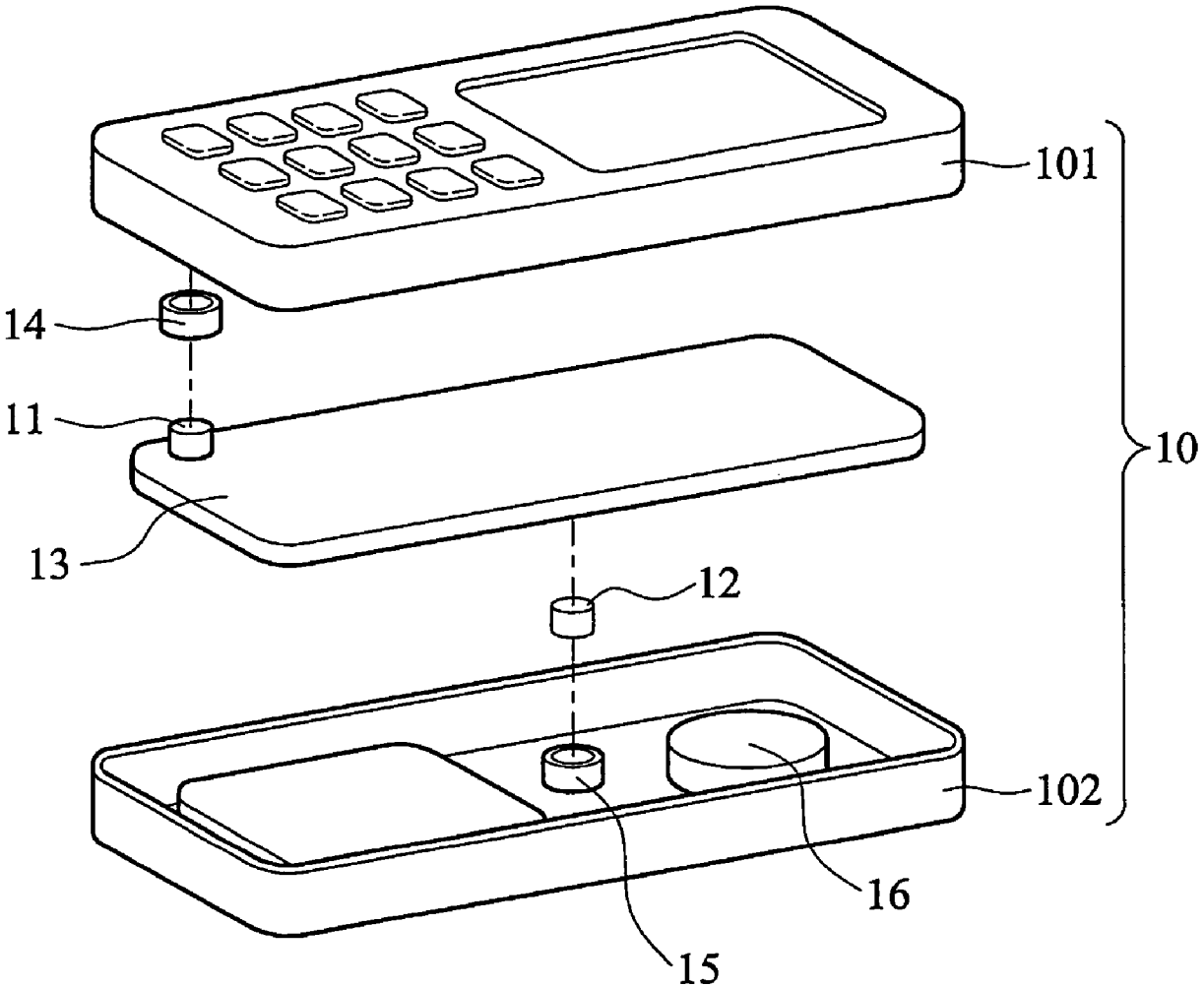
FIG. 1A is a perspective diagram of an electronic device in accordance with a first embodiment of the invention.

Referring to FIG. 1A, in a first embodiment of the invention, the electronic device is a cellular phone which includes a front cover 101, a rear cover 102, a first microphone 11, a second microphone 12, a loudspeaker 16, and a circuit board 13. The front cover 101 and the rear cover 102 constitute a housing 10 to cover the other elements 11, 12, 13 and 16.

Figure 1C:
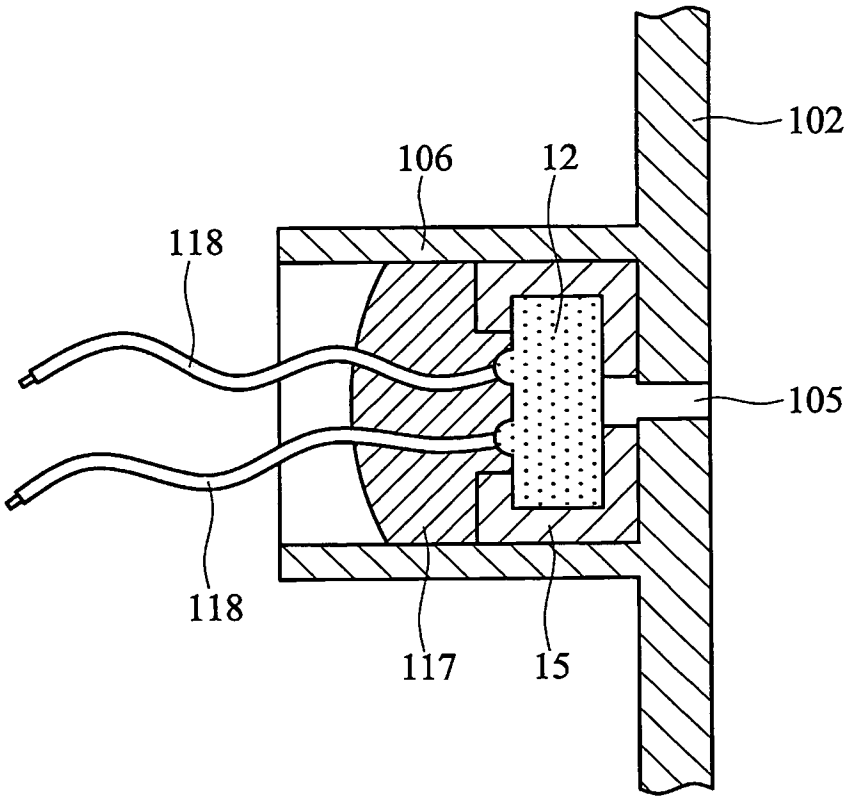
FIG. 1C is a sectional view of the second microphone of FIG. 1A.
Figure 1B:
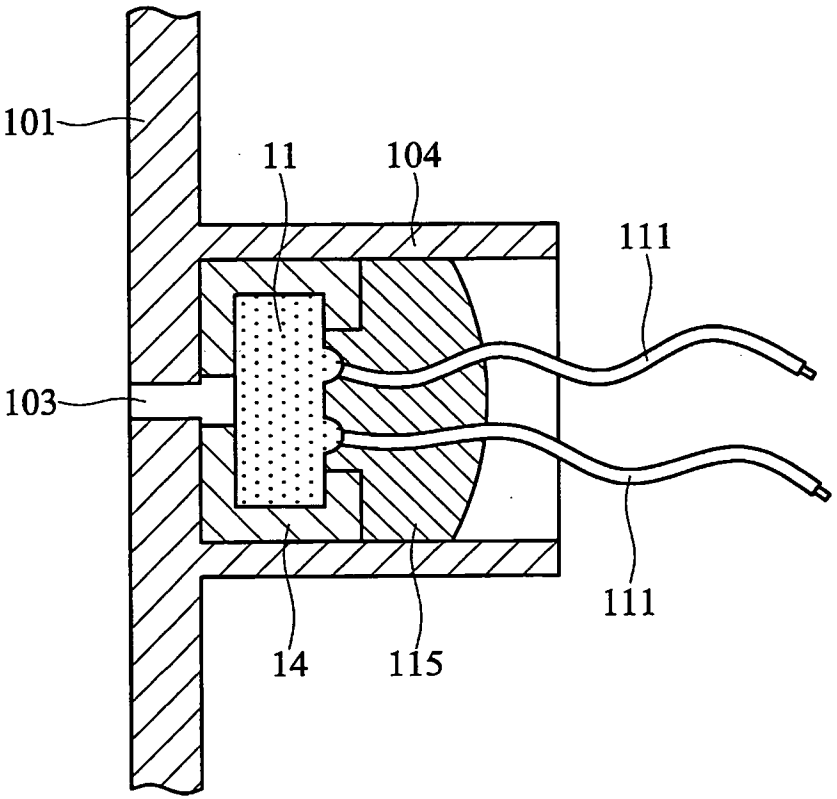
FIG. 1B is a sectional view of the first microphone of FIG. 1A.

Referring to FIG. 1B, the first microphone 11 is fitted into a flexible boot 14. The front cover 101 of the cellular phone has a chamber 104 protruding inward to accommodate the first microphone 11 and the flexible boot 14. The flexible boot 14 is used for protecting the first microphone 11 from vibrations. Furthermore, the first microphone 11 is electrically connected to the circuit board 13 through electrical wires 111 rather than surface-mounted onto the circuit board 13. This arrangement avoids vibrations from the circuit board 13 to be transmitted to the first microphone 11. The front cover 101 further has a first acoustic opening 103 allowing the first microphone 11 to receive external sound. Sealing glue 115 is applied to the rear of the first microphone 11 in the chamber 104. Both of the flexible boot 14 and the sealing glue 115 provide sound proofing, preventing sound transmission between the first acoustic opening 103 and the inside of the housing 10.

Referring to FIG. 1C, similar to the first microphone 11, the second microphone 12 is fitted into a flexible boot 15. The rear cover 102 of the cellular phone has a chamber 106 protruding inward to accommodate the second microphone 12 and the flexible boot 15. The flexible boot 15 is used for protecting the second microphone 12 from vibrations. Furthermore, the second microphone 12 is electrically connected to the circuit board 13 through electrical wires 118 rather than surface-mounted on the circuit board 13. This arrangement avoids vibrations from the circuit board 13 to be transmitted to the second microphone 12. The rear cover 102 of the cellular phone further has a second acoustic opening 105 allowing the second microphone 12 to receive external sound. Sealing glue 117 is applied to the rear of the second microphone 12 in the chamber 106. The flexible boot 15 and the sealing glue 117 provide sound proofing, preventing sound transmission between the second acoustic opening 105 and the inside of the housing 10.

Figure 1D:
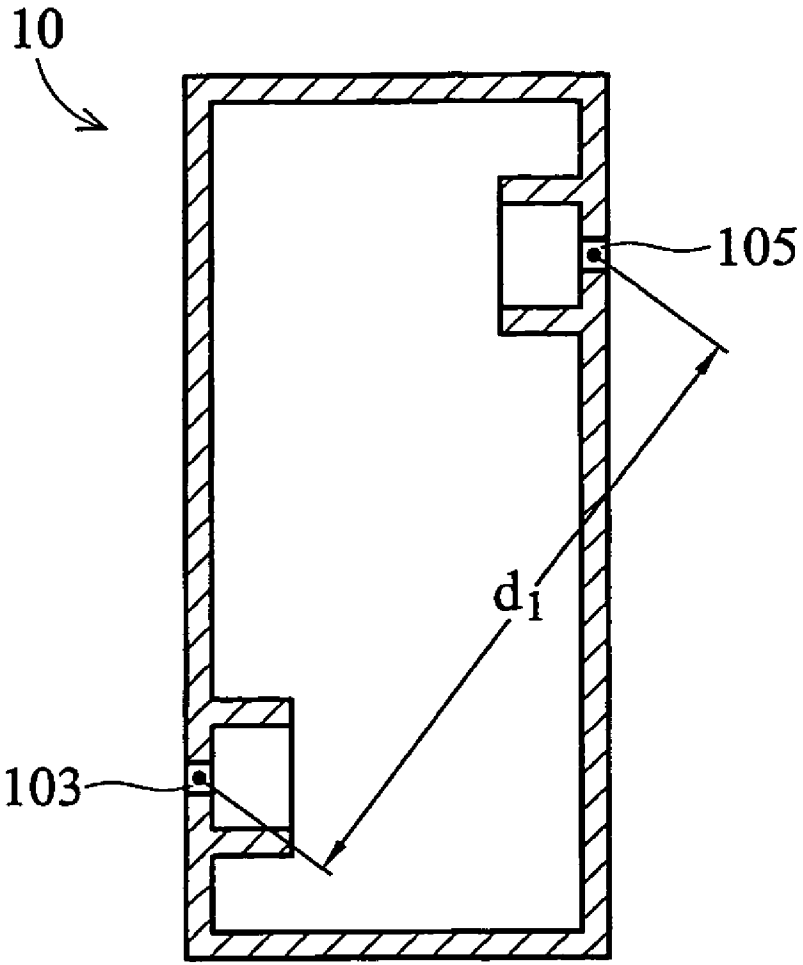
FIG. 1D is a schematic diagram showing the locations of the first acoustic opening and the second acoustic opening in the electronic device of FIG. 1A.

Both the first microphone 11 and the second microphone 12 are omni-directional microphones which constitute a microphone array. During operation, the first microphone 11 is located close to a user's mouth (i.e. the target sound source) to serve as a main microphone. The second microphone 12, closer to the loudspeaker 16 than the first microphone 11, serves as a reference microphone. Additionally, the distance d1 between the first and second acoustic openings 103 and 105 (FIG. 1D) is at least about 8 cm. Thus, the short-distance (≦200 mm) sound signal received by the first microphone 11 is stronger than that received by the second microphone 12. The long-distance (≧2000 mm) noise received by the first microphone 11 is approximately equal to that received by the second microphone 12 in signal strength. The echo signal received by the first microphone 11 is weaker than that received by the second microphone 12. Thus, a beam pattern resembling the super-short-heart shape for the short-distance signal can be formed, wherein the noise (e.g. echo and side tone) outside the beam is suppressed. Furthermore, the middle-distance (200 mm-2000 mm) signal and the long-distance single (e.g. echo, sound of wind, and background noise) from all directions are suppressed.

Preferably, the first microphone 11 and the second microphone 12 are identical, the flexible boots 14 and 15 are identical, the chambers 104 and 106 are identical, and the first and second acoustic openings 103 and 105 are identical. This can ensure that the sound spectrums obtained by the first microphone 11 and the second microphone 12 are consistent, thus effectively suppressing noise.

Figure 2A:
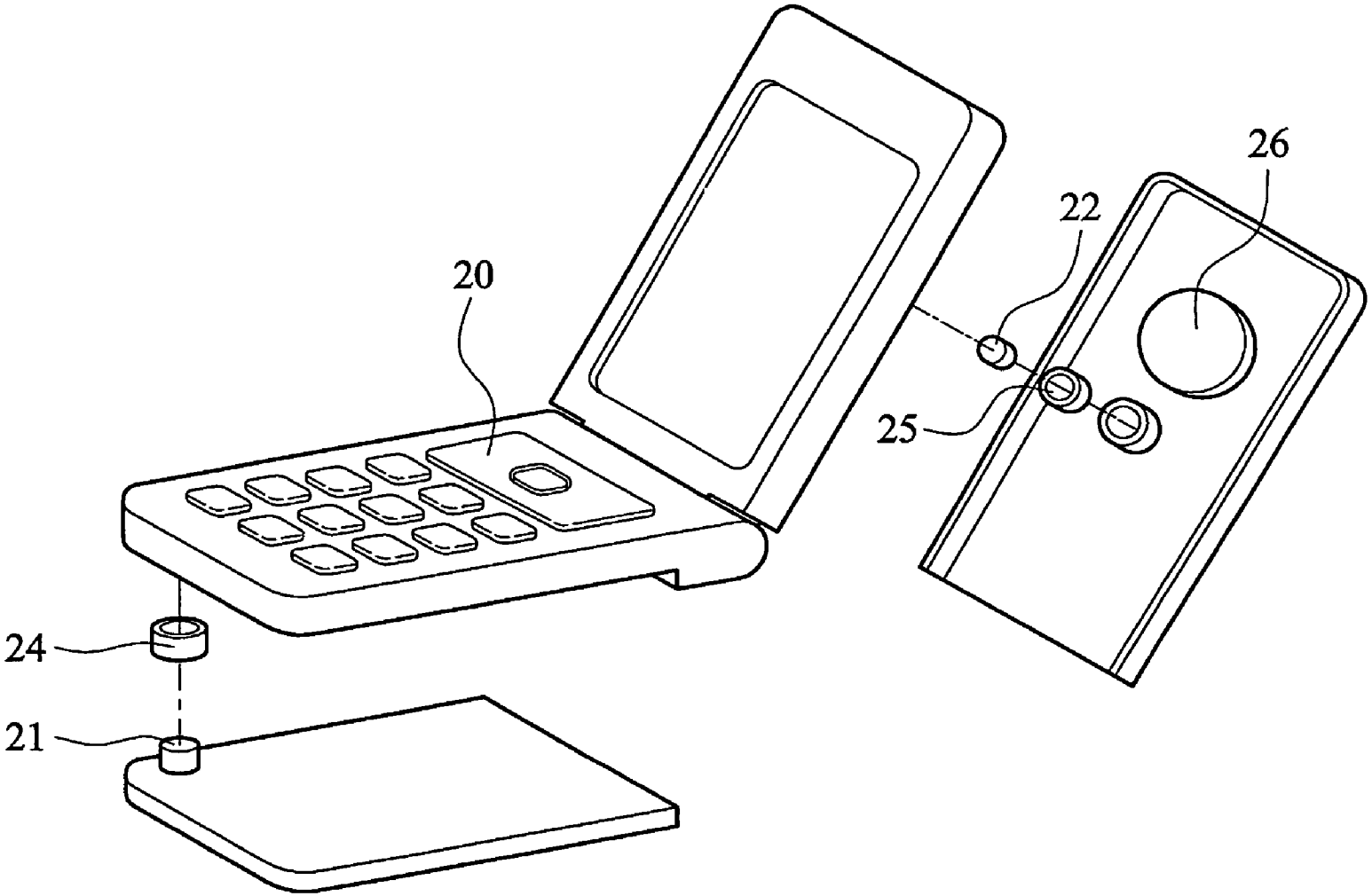
FIG. 2A is a perspective diagram of an electronic device in accordance with a second embodiment of the invention.

Referring to FIG. 2A, in a second embodiment of the invention, the electronic device is a flip-up cellular phone which includes a housing 20, a first microphone 21, a second microphone 22, and a loudspeaker 26. The housing 20 covers the other elements 21, 22, and 26.

Figure 2C:
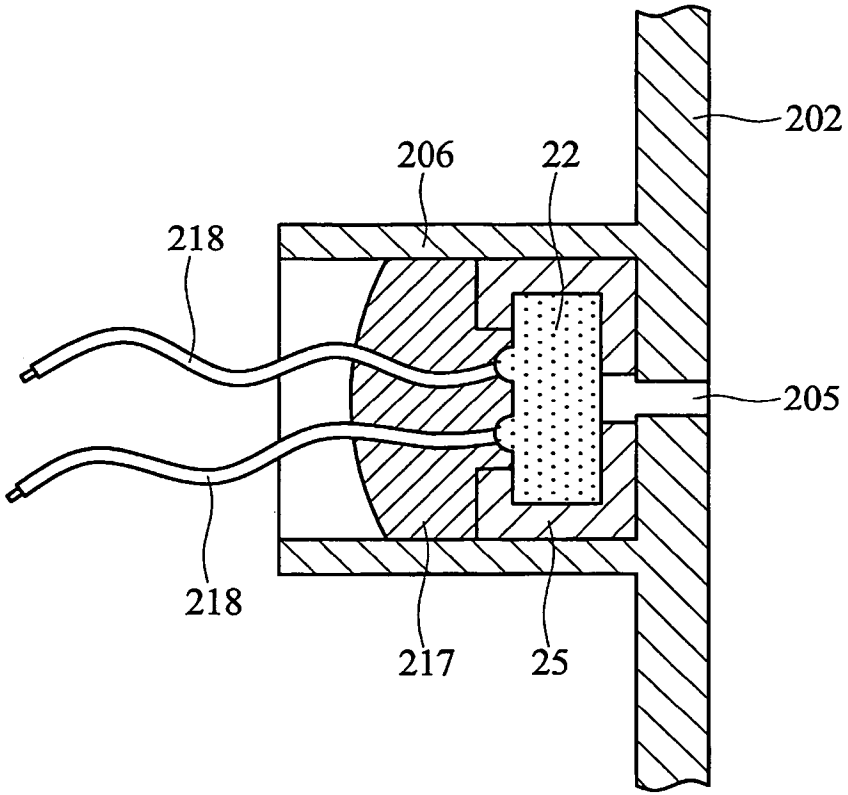
FIG. 2C is a sectional view of the second microphone of FIG. 2A.
Figure 2B:
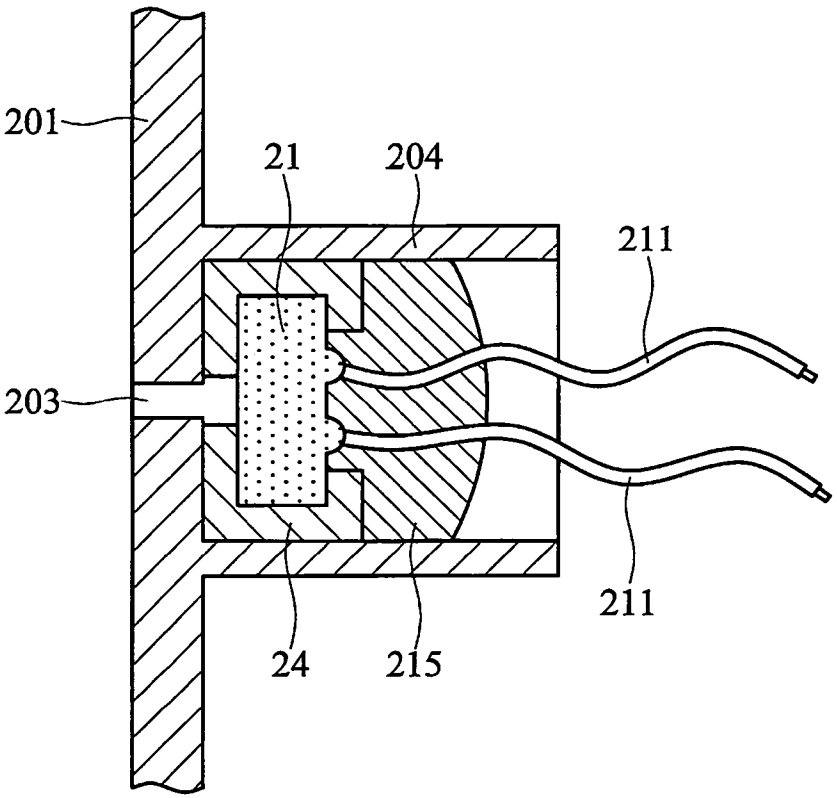
FIG. 2B is a sectional view of the first microphone of FIG. 2A.

Referring to FIG. 2B, the first microphone 21 is fitted into a flexible boot 24. The front cover 201 of the cellular phone has a chamber 204 protruding inward to accommodate the first microphone 21 and the flexible boot 24. The flexible boot 24 is used for protecting the first microphone 21 from vibrations. Furthermore, the first microphone 21 is electrically connected to a circuit board (not shown) through electrical wires 211 rather than surface-mounted on the circuit board. This arrangement avoids vibrations from the circuit board to be transmitted to the first microphone 21. The front cover 201 further has a first acoustic opening 203 allowing the first microphone 21 to receive external sound. Sealing glue 215 is applied to the rear of the first microphone 21 in the chamber 204. Both of the flexible boot 24 and the sealing glue 215 provide sound proofing, preventing sound transmission between the first acoustic opening 203 and the inside of the housing 20.

Referring to FIG. 2C, similar to the first microphone 21, the second microphone 22 is fitted into a flexible boot 25. The rear cover 202 of the cellular phone has a chamber 206 protruding inward to accommodate the second microphone 22 and the flexible boot 25. The flexible boot 25 is used for protecting the second microphone 22 from vibrations. Furthermore, the second microphone 22 is electrically connected to the circuit board (not shown) through electrical wires 218 rather than surface-mounted on the circuit board. This arrangement avoids vibrations from the circuit board to be transmitted to the second microphone 22. The rear cover 202 of the cellular phone further has a second acoustic opening 205 allowing the second microphone 22 to receive external sound. Sealing glue 217 is applied to the rear of the second microphone 22 in the chamber 206. The flexible boot 25 and the sealing glue 217 provide sound proofing, preventing sound transmission between the second acoustic opening 205 and the inside of the housing 20.

Figure 2D:
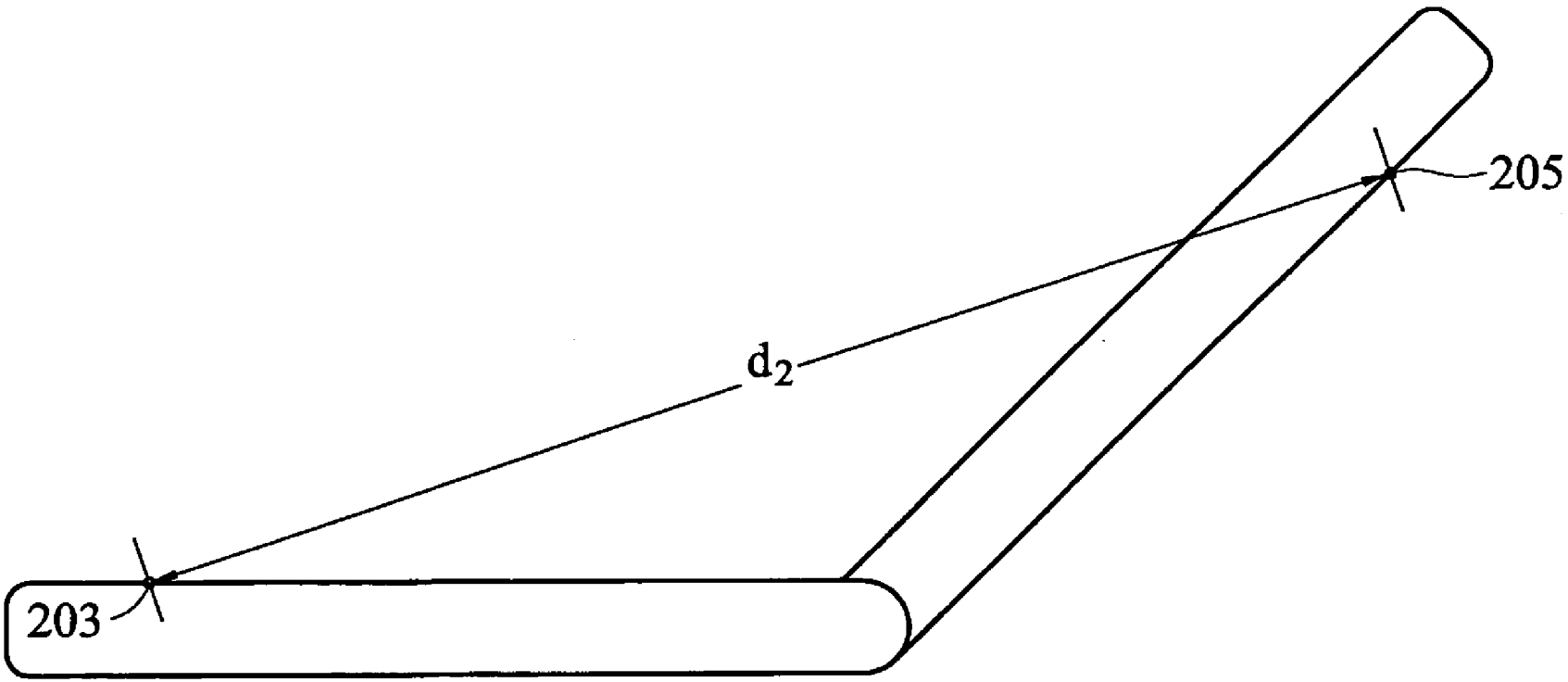
FIG. 2D is a schematic diagram showing the locations of the first acoustic opening and the second acoustic opening in the electronic device of FIG. 2A.

Both the first microphone 21 and the second microphone 22 are omni-directional microphones which constitute a microphone array. During operation, the first microphone 21 is located close to a user's mouth (i.e. the target sound source) to serve as a main microphone. The second microphone 22, closer to the loudspeaker 26 than the first microphone 21, serves as a reference microphone. Additionally, the distance d2 between the first and second acoustic openings 203 and 205 (FIG. 2D) is at least about 8 cm. Thus, the short-distance sound signal received by the first microphone 21 is stronger than that received by the second microphone 22. The long-distance noise received by the first microphone 21 is approximately equal to that received by the second microphone 22 in signal strength. The echo signal received by the first microphone 21 is weaker than that received by the second microphone 22. Thus, a beam pattern resembling the super-short-heart shape for the short-distance signal can be formed, wherein the noise (e.g. echo and side tone) outside the beam is suppressed. Furthermore, the middle-distance signal and the long-distance single (e.g. echo, sound of wind, and background noise) from all directions are suppressed.

Preferably, the first microphone 21 and the second microphone 22 are identical, the flexible boots 24 and 25 are identical, the chambers 204 and 206 are identical, and the first and second acoustic openings 203 and 205 are identical. This can ensure that the sound spectrums obtained by the first microphone 21 and the second microphone 22 are consistent, thus effectively suppressing the noise.

Figure 3A:
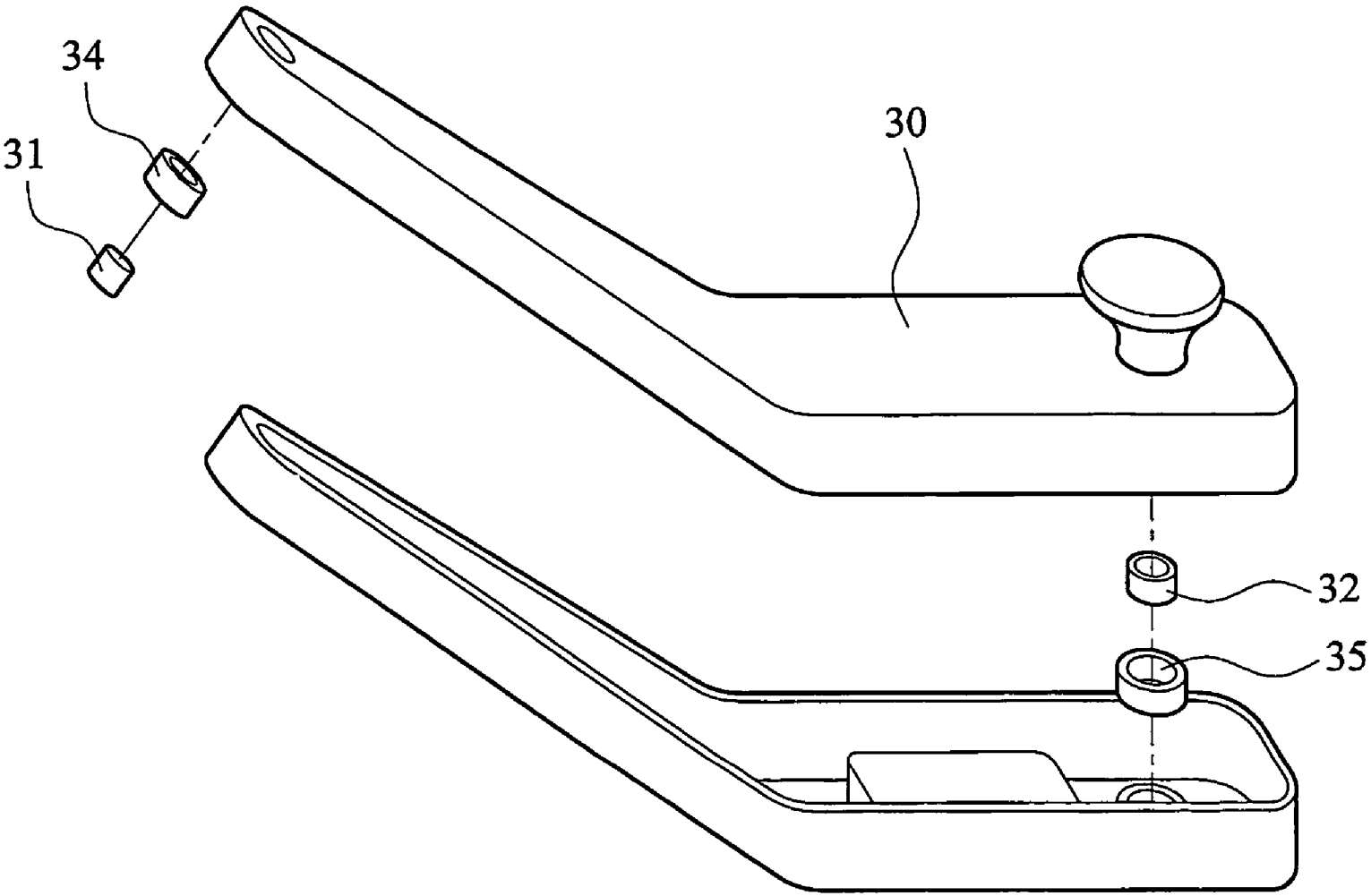
FIG. 3A is a perspective diagram of an electronic device in accordance with a third embodiment of the invention.

Referring to FIG. 3A, in a third embodiment of the invention, the electronic device is a bluetooth earphone which includes a housing 30, a first microphone 31, a second microphone 32, and a loudspeaker 36. The housing 30 covers the other elements 31, 32, and 36.

Figure 3C:
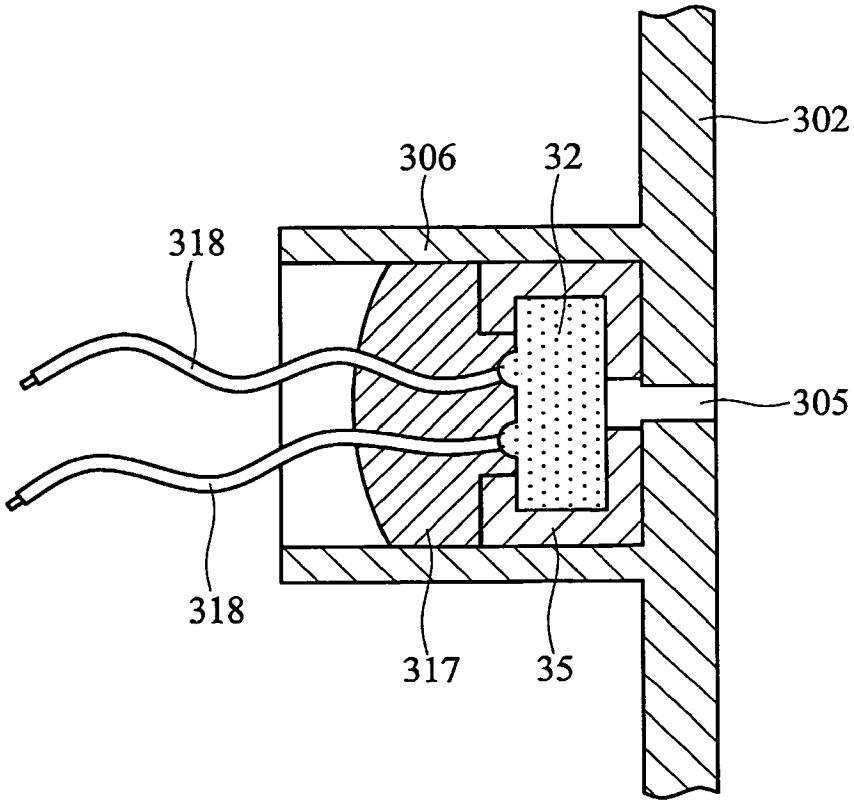
FIG. 3C is a sectional view of the second microphone of FIG. 3A.
Figure 3B:
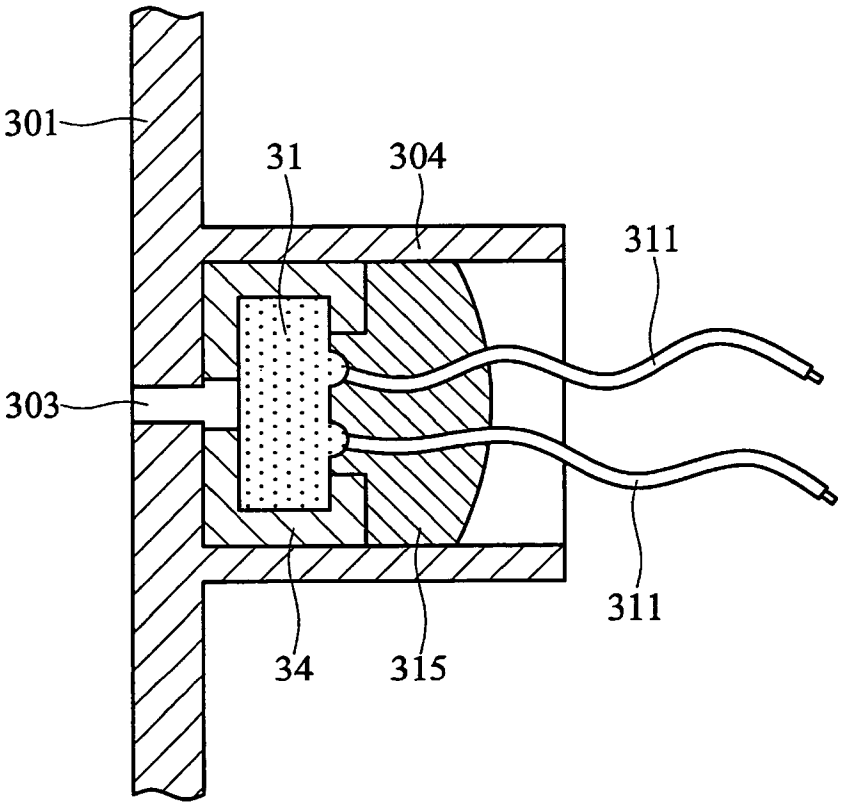
FIG. 3B is a sectional view of the first microphone of FIG. 3A.

Referring to FIG. 3B, the first microphone 31 is fitted into a flexible boot 34. The front cover 301 of the earphone has a chamber 304 protruding inward to accommodate the first microphone 31 and the flexible boot 34. The flexible boot 34 is used for protecting the first microphone 31 from vibrations. Furthermore, the first microphone 31 is electrically connected to a circuit board (not shown) through electrical wires 311 rather than surface-mounted on the circuit board. This arrangement avoids vibrations from the circuit board to be transmitted to the first microphone 31. The front cover 301 further has a first acoustic opening 303 allowing the first microphone 31 to receive external sound. Sealing glue 315 is applied to the rear of the first microphone 31 in the chamber 304. Both of the flexible boot 34 and the sealing glue 315 provide sound proofing, preventing sound transmission between the first acoustic opening 303 and the inside of the housing 30.

Referring to FIG. 3C, similar to the first microphone 31, the second microphone 32 is fitted into a flexible boot 35. The rear cover 302 of the earphone has a chamber 306 protruding inward to accommodate the second microphone 32 and the flexible boot 35. The flexible boot 35 is used for protecting the second microphone 32 from vibrations. Furthermore, the second microphone 32 is electrically connected to the circuit board (not shown) through electrical wires 318 rather than surface-mounted on the circuit board. This arrangement avoids vibrations from the circuit board to be transmitted to the second microphone 32. The rear cover 302 of the earphone further has a second acoustic opening 305 allowing the second microphone 32 to receive external sound. Sealing glue 317 is applied to the rear of the second microphone 32 in the chamber 306. The flexible boot 35 and the sealing glue 317 provide sound proofing, preventing sound transmission between the second acoustic opening 305 and the inside of the housing 30.

Figure 3D:
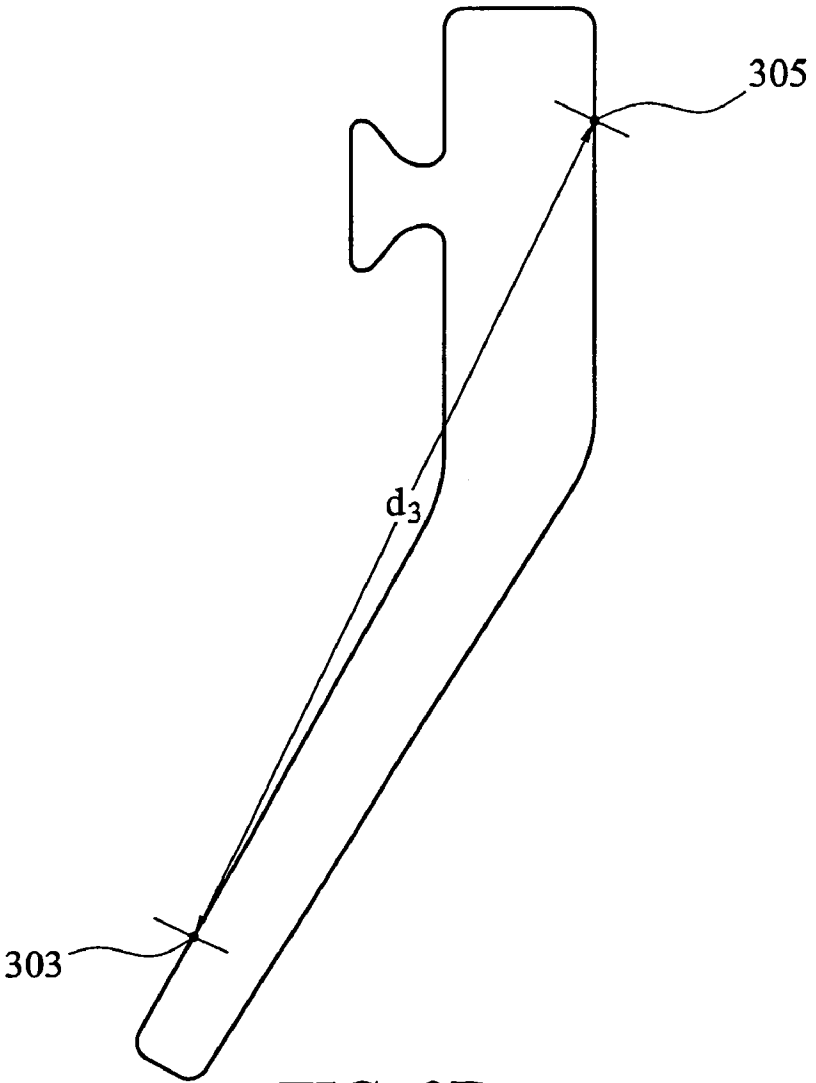
FIG. 3D is a schematic diagram showing the locations of the first acoustic opening and the second acoustic opening in the electronic device of FIG. 3A.

Both the first microphone 31 and the second microphone 32 are omni-directional microphones which constitute a microphone array. During operation, the first microphone 31 is located close to a user's mouth (i.e. the target sound source) to serve as a main microphone. The second microphone 32, closer to the loudspeaker 36 than the first microphone 31, serves as a reference microphone. Additionally, the distance d3 between the first and second acoustic openings 303 and 305 (FIG. 3D) is about 8 cm or more. Thus, the short-distance sound signal received by the first microphone 31 is stronger than that received by the second microphone 32. The long-distance noise received by the first microphone 31 is approximately equal to that received by the second microphone 32 in signal strength. The echo signal received by the first microphone 31 is weaker than that received by the second microphone 32. Thus, a beam pattern resembling the super-short-heart shape for the short-distance signal can be formed, wherein the noise (e.g. echo and side tone) outside the beam is suppressed. Furthermore, the middle-distance signal and the long-distance single (e.g. echo, sound of wind, and background noise) from all directions are suppressed.

Preferably, the first microphone 31 and the second microphone 32 are identical, the flexible boots 34 and 35 are identical, the chambers 304 and 306 are identical, and the first and second acoustic openings 303 and 305 are identical. This can ensure that the sound spectrums obtained by the first microphone 31 and the second microphone 32 are consistent, thus effectively suppressing the noise.

Figure 4A:
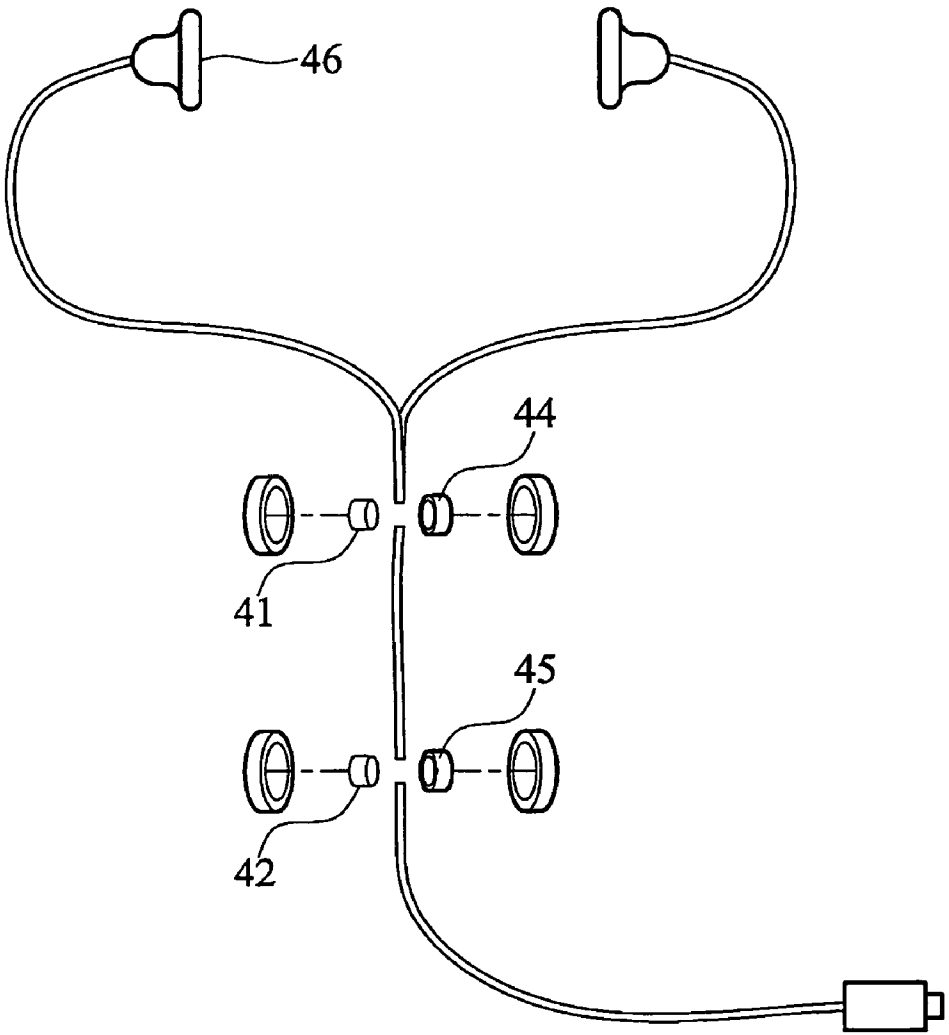
FIG. 4A is an exploded perspective diagram of an electronic device in accordance with a fourth embodiment of the invention.
Figure 4B:
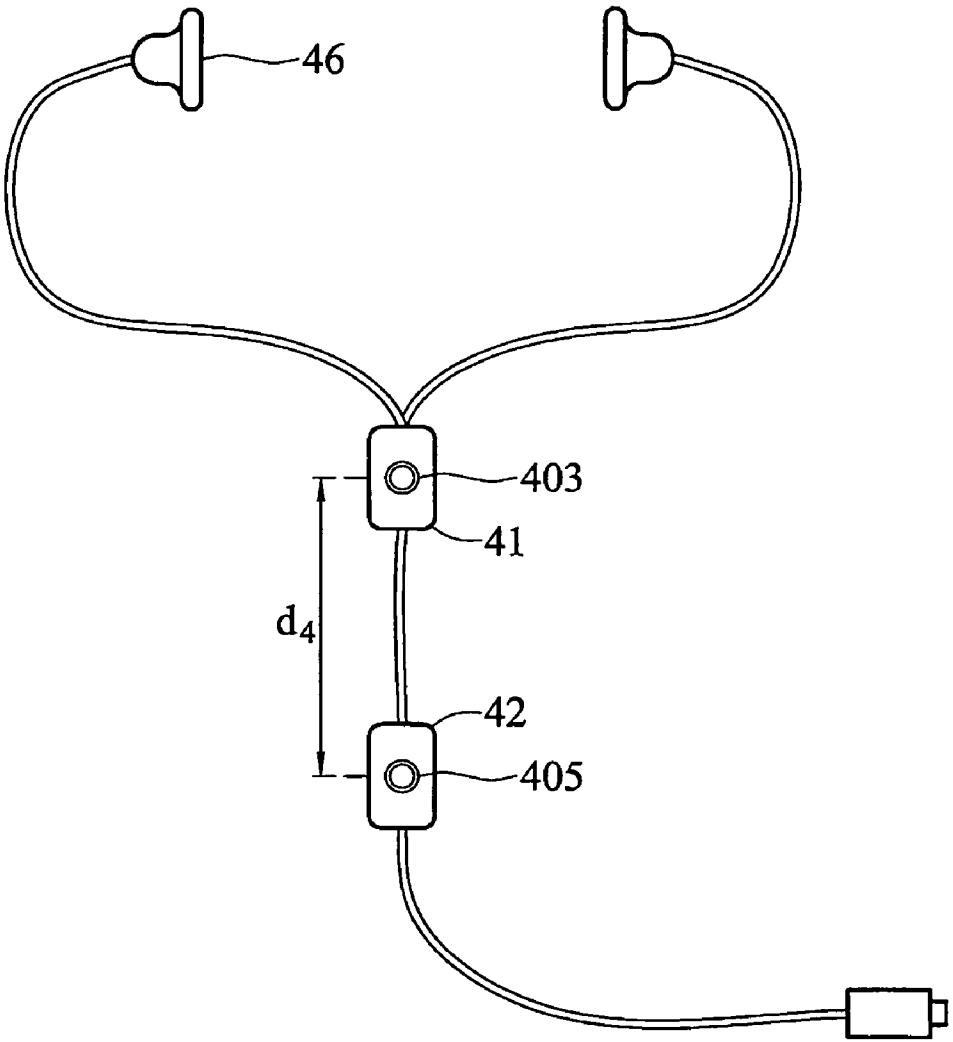
FIG. 4B depicts the assembled electronic device of FIG. 4A.

Referring to FIGS. 4A and 4B, in a fourth embodiment of the invention, the electronic device is an earphone which includes a first microphone 41, a second microphone 42, and two loudspeakers 46. The first microphone 41 is spaced apart from the second microphone 42 by a distance d4. In the fourth embodiment, the distance d4 is at least 8 cm.

The first microphone 41 and the second microphone 42 are fitted into flexible boots 44 and 45, respectively. The flexible boots 44 and 45 are used for protecting the first microphone 41 and the second microphone 42 from vibrations.

Both the first microphone 41 and the second microphone 42 are omni-directional microphones which constitute a microphone array. During operation, the first microphone 41 is located close to a user's mouth (i.e. the target sound source) to serve as a main microphone. The second microphone 42, father from the loudspeaker 46 than the first microphone 41, serves as a reference microphone. Additionally, the distance d4 between the first and second acoustic openings 403 and 405 (FIG. 4B) is about 8 cm or more. Thus, the short-distance sound signal received by the first microphone 41 is stronger than that received by the second microphone 42. The long-distance noise received by the first microphone 41 is approximately equal to that received by the second microphone 42 in signal strength. Thus, a beam pattern resembling the super-short-heart shape for the short-distance signal can be formed, wherein the noise (e.g. echo and side tone) outside the beam is suppressed. Furthermore, the middle-distance signal and the long-distance single (e.g. echo, sound of wind, and background noise) from all directions are suppressed.

Preferably, the first microphone 41 and the second microphone 42 are identical, the flexible boots 44 and 45 are identical, and the first and second acoustic openings 403 and 405 are identical. This can ensure that the sound spectrums obtained by the first microphone 41 and the second microphone 42 are consistent, thus effectively suppressing the noise.

It is understood that the electronic device of the invention can be a cellular phone, an earphone, MP3 player, personal digital assistant (PDA), a sound recorder, or other similar devices.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic device, comprising:

a first acoustic opening;

a first microphone, receiving sound through the first acoustic opening, serving as a main microphone close to a target sound source;

a second acoustic opening at least about 8 cm distant from the first acoustic opening;

a second microphone receiving the sound through the second acoustic opening, wherein the first microphone and the second microphone are identical and are omni-directional microphones, and the second microphone servers as a reference microphone for suppressing noise;

two identical flexible boots in which the first microphone and the second microphone are disposed;

two identical chambers in which the flexible boots are disposed; and a loudspeaker, wherein the second microphone is closer to or farther from the loudspeaker than the first microphone.

2. The electronic device as claimed in claim 1, wherein the first acoustic opening and the second acoustic opening are identical.

3. The electronic device as claimed in claim 1, further comprising a housing in which the first microphone and the second microphone are disposed, wherein the first and second acoustic openings are provided in the housing.

4. The electronic device as claimed in claim 1, further comprising a circuit board and a plurality of electrical wires through which the first microphone and the second microphone are connected to the circuit board.

5. The electronic device as claimed in claim 1, wherein the electronic device is a cellular phone, an earphone, a MP3 player, a personal digital assistant, or a sound recorder.

* * * * *